US006971964B1

(12) United States Patent
Bothwell

(10) Patent No.: US 6,971,964 B1
(45) Date of Patent: Dec. 6, 2005

(54) COMPOUND SPRING ELEMENT FOR A GAME RACKET

(76) Inventor: Brett Peter Bothwell, 101 W. 75th St. (3B), New York, NY (US) 10023

( * ) Notice: Subject to any disclaimer, the term of this patent is extended or adjusted under 35 U.S.C. 154(b) by 0 days.

(21) Appl. No.: 10/678,241

(22) Filed: Oct. 3, 2003

(51) Int. Cl.[7] ..... A63B 49/02
(52) U.S. Cl. ..... 473/521; 473/540; 473/548
(58) Field of Search ..... 473/520–522, 473/524, 534, 539–541, 543, 548, 553

(56) References Cited

U.S. PATENT DOCUMENTS

| | | | | |
|---|---|---|---|---|
| 360,468 | A * | 4/1887 | Phelps | 473/534 |
| 2,034,444 | A * | 3/1936 | Rauch et al. | 473/534 |
| 3,874,667 | A * | 4/1975 | Gallagher et al. | 473/541 |
| 4,206,917 | A * | 6/1980 | Guillem et al. | 473/521 |
| 4,441,712 | A | 4/1984 | Guthke | |
| 4,681,319 | A | 7/1987 | Zilinskas | |
| 4,765,620 | A | 8/1988 | Janes | |
| 4,772,021 | A * | 9/1988 | Maynard | 473/521 |
| 4,983,242 | A | 1/1991 | Reed | |
| 5,102,132 | A | 4/1992 | Chen | |
| 5,137,769 | A | 8/1992 | Landi | |
| 5,165,687 | A | 11/1992 | Soong | |
| 5,458,331 | A | 10/1995 | Bothwell | |
| 5,944,625 | A * | 8/1999 | Janes | 473/548 |
| 6,503,161 | B2 | 1/2003 | Bothwell | |
| 6,506,134 | B2 | 1/2003 | Bertolotti | |
| 6,530,851 | B2 | 3/2003 | Munster | |
| 2002/0039937 | A1 * | 4/2002 | Bothwell | 473/520 |

* cited by examiner

*Primary Examiner*—Raleigh W. Chiu

(57) ABSTRACT

A compound spring element for a game racket frame is provided. A resilient casing forms the spring element, with its profile having a first side portion and a second side portion defining at least one space between them. The at least one space contains at least one damping and/or tension element which interacts with the casing to form a semi-rigid, damped, compound structural unit that is flexurally resistant to string tension. It can be disposed in any number of advantageous positions on at least one part of a head frame to cooperate with at least one string.

37 Claims, 5 Drawing Sheets

COMPOUND SPRING ELEMENT FOR A GAME RACKET

FIELD OF THE INVENTION

The present invention is intended for use on a game racket, in particular on a racket frame having strings held in tension and shaped to receive a compound spring element.

BACKGROUND INFORMATION

Reducing vibration and increasing the liveliness if the strings are well known themes in game racket design. Some of the most effective are those that simultaneously address these two issues at the connection between the strings and the head frame.

The game racket of U.S. Pat. No. 5,458,331 utilizes a fluid chamber to dampen shock and improve the string response. The racket head has an inner frame and an outer frame profile and the chamber is formed by the space in between. The game racket of U.S. Pat. No. 6,530,851 shows a similar use of an inner frame and a chamber defined by an outer frame that rests on the inner frame. The tension frame as it's called, is laced through with strings in tension to form an elastic connection with the inner frame.

One inherent difficulty in both designs is that the chambers are defined on one side by the body of the inner head frame. This limits both the types of head frame profiles that can be used and the possible locations for the chamber(s). It would be advantageous to have a chamber within a structurally independent unit to allow greater flexibility in designing and manufacturing. A second problem with the previous art, is that the string and or grommet penetrates and slides, piston like, through the chamber(s), making it difficult to maintain fluid pressure without the use of a hose or bladder. It would be beneficial to have a structurally independent chamber that can withstand fluid pressure without the use of a hose or bladder.

Additionally, the range of elastic response to string tension in the tension frame of the game racket of U.S. Pat. No. 6,530,851 is limited by the minimal flexural capacity of the tension frame. The elastic response of the strings could be greatly enhanced by increasing the flexural capacity of the tension frame profile. And lastly, in the previous art, the damping and/or elastomeric material within the chamber and the outer profiles are separate pieces. It would be very convenient and efficient to have the damping and/or elastomeric elements integral within a structurally independent unit.

One object of the present invention is to improve the playing quality of a game racket. Another object of the present invention is to unite the best qualities of a damping chamber and a tension frame in a structurally independent element which is easily manufactured and is variously position-able on the head frame profile. Another object is to attenuate impact shock and vibration. Another object of the present invention is to improve the rebound towards a perimeter of the stringing and thus to expand the optimum hitting area.

Still another object is to provide a damped spring element which is adaptable to a wide range of frame profiles. Another object is to accommodate conventional stringing standards while making it possible to affect the entire stringed surface. It is another object of the present invention to provide an efficient, structurally independent damped spring element which can be made separately from the frame if desired.

To achieve these objects, a compound spring element according to the present invention, is provided for a game racket frame. A resilient, casing forms the spring element, with its profile having a first side portion and a second side portion and defining at least one space in between them. The at least one space contains at least one damping and/or elastomeric element which interacts with the casing to form a damped, compound structural unit that is flexurally resistant to string tension. It can be disposed in any number of advantageous positions on at least one part of a head frame to cooperate with at least one string.

BRIEF DESCRIPTION OF THE FIGURES

FIG. 2B shows the element holding a string in tension.

FIGS. 3A and 3B are representations similar to FIGS. 2A and 2B showing a second embodiment of the compound spring element disposed in alternative positions on a simplified representation of a head frame profile. FIG. 3A shows the spring element disposed nearer the midpoint of an opening in the head frame. FIG. 3B shows the element disposed nearer to the stringing within an opening in the head frame.

DETAILED DESCRIPTION OF THE INVENTION

According to a preferred embodiment, the present invention is intended for use with a typical game racket frame including a handle and a head frame holding a strings in tension. The present invention is a compound spring element for a game racket frame and is described herein. The components, including the element and the racket, may be lightweight and durable and can be composed of materials known to those having ordinary skill in the Art. Fiber-reinforced plastic and metal alloy for example, are suitable materials for the intended purpose.

Figure 1:
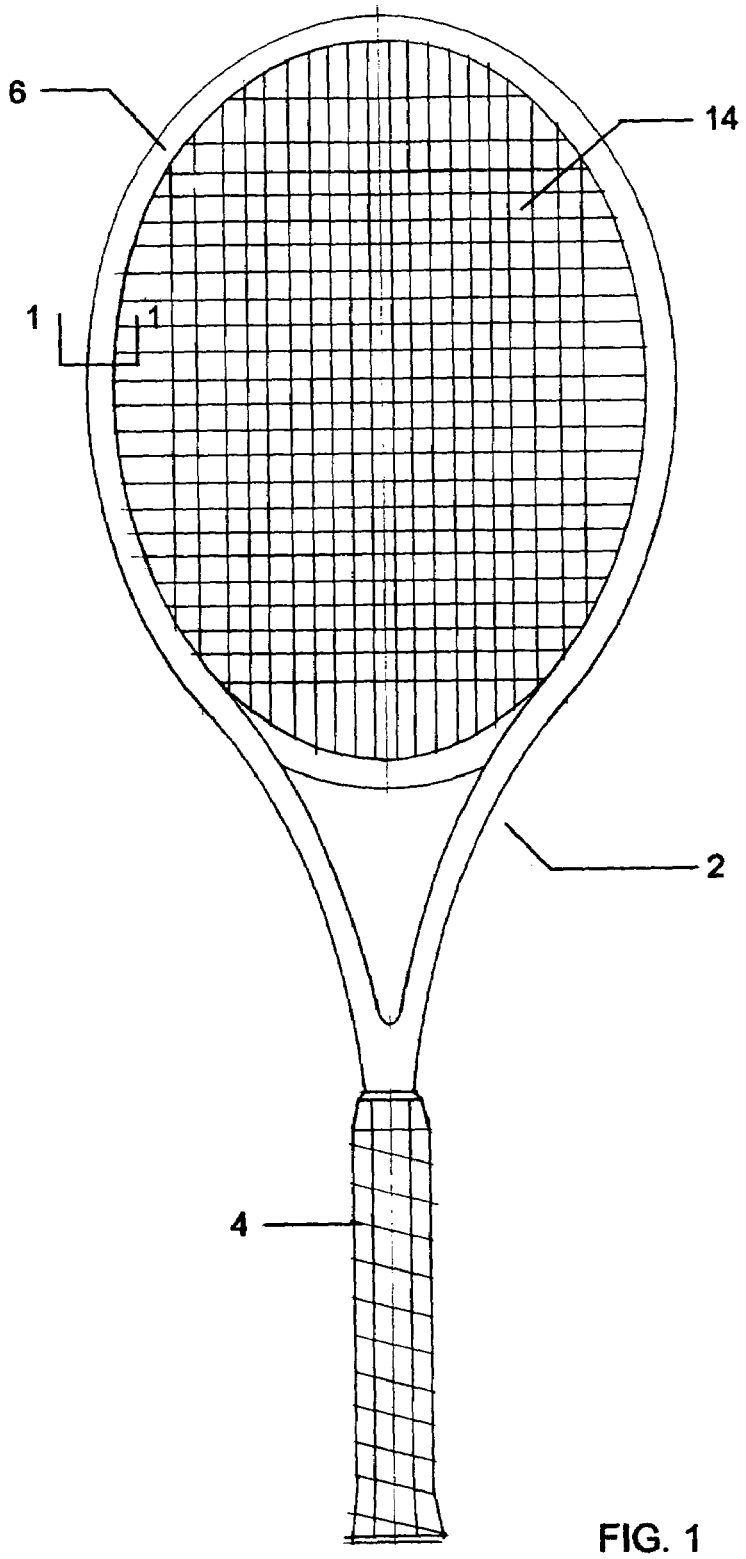
FIG. 1 shows a simplified representation of a game racket for which the present invention is intended.

FIG. 1 shows a simplified representation of a typical game racket frame 2 with a handle 4 and a head frame 6 holding the stringing 14 in tension. The typical cross-sectional view designated by line 1—1 in FIG. 1 is but one of many appropriate locations on a periphery of the stringing 14 for the compound spring element of the present invention.

Figure 2A:
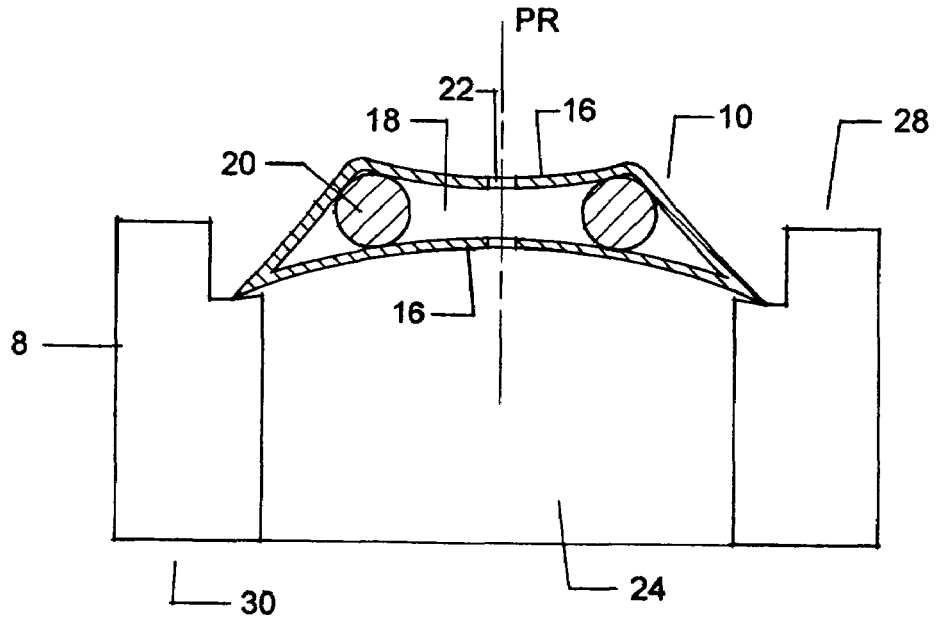
FIGS. 2A and 2B show cross-sectional views corresponding to line 1—1 in FIG. 1 of a first embodiment of a compound spring element.
Figure 2B:
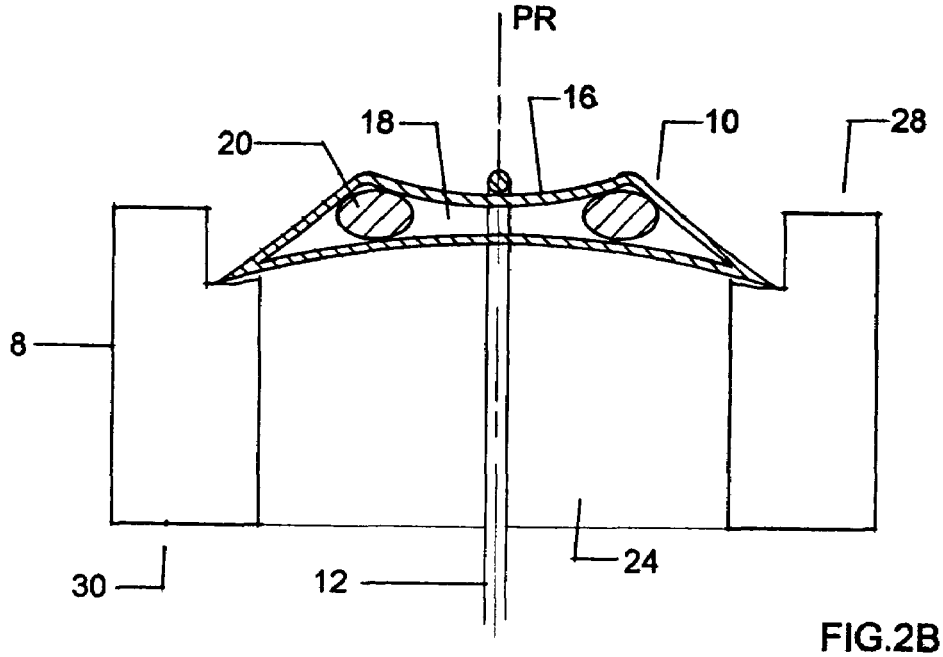

FIG. 2A shows a cross-sectional view along line 1—1 of a first embodiment of a compound spring element 10 according to the present invention. The spring element 10 is shown disposed on a simplified representation of a head frame profile 8. Though there are a number of possible locations for the element 10, in this particular view, the spring element 10 is disposed in an opening 24 nearer to an outer facing surface 28 of the head frame profile 8. A profile of the resilient casing 16 of the spring element 10 is depicted here with a closed profile and two side portions defining one space in between and made of a suitable material such has fiber-reinforced plastic or metal or a combination thereof. Two damping and/or elastomeric elements 20 are shown within the space 18, though more are possible, including at least one element 20 disposed between at least two holes 22 along a central axis defined by the stringing plane PR. The casing 16 and the space 18 are penetrated by a hole 22 along the axis of the string plane PR. FIG. 2B illustrates the same embodiment of the spring element 10 holding a string 12 in tension. In this particular version, the string 12 is laced through to the outer facing surface 28 of the casing 16. Tension in the string 12 initiates a composite structural interaction including the side portions of the resilient casing 16 and the elements 20 within the space 18. When the tension of the string 12 has increased for example, due to ball impact, the outer facing surface 28 of the casing deflects, compressing the space 18 and prompting the opposite side of the casing 16 to resist the increased pressure. The result is a damped, flexible response that alleviates increased string 12 tension upon ball impact for added dwell time, and subsequently accelerates an increase in string 12 tension as the spring element returns to its original shape, and the ball is propelled from the string 12. The elastic capacity of the compound spring element 10 and the play of the racket 2 generally, is greatly enhanced by the synchronized relationship of the resilient casing 16 and the element(s) 20 in the space 18. The parts unite structurally to achieve a semi-rigid state having both flexural resistance and damping properties.

Figure 3A:
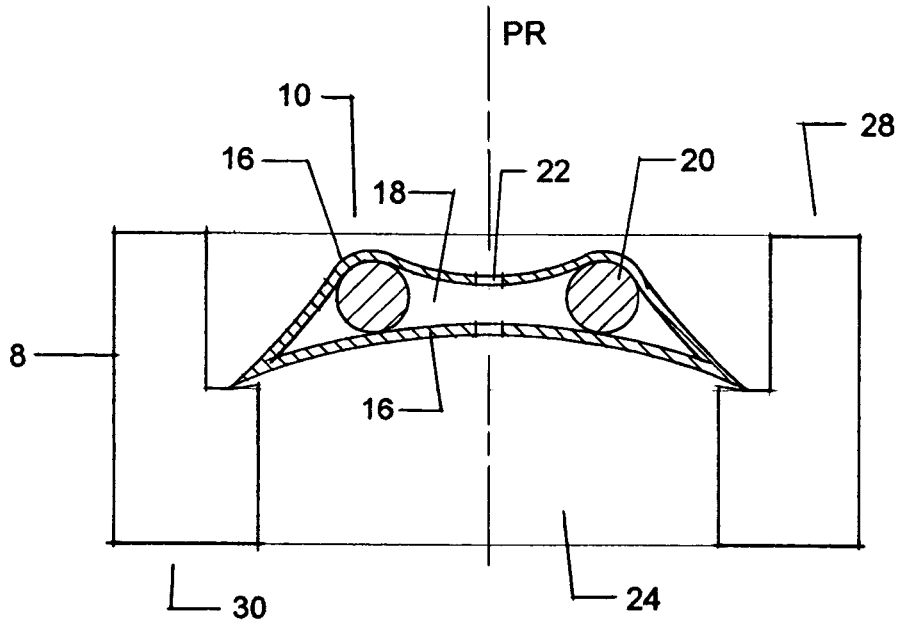
FIG. 3A shows the element in one possible location nearer an outer facing surface of a simplified head frame profile.
Figure 3B:
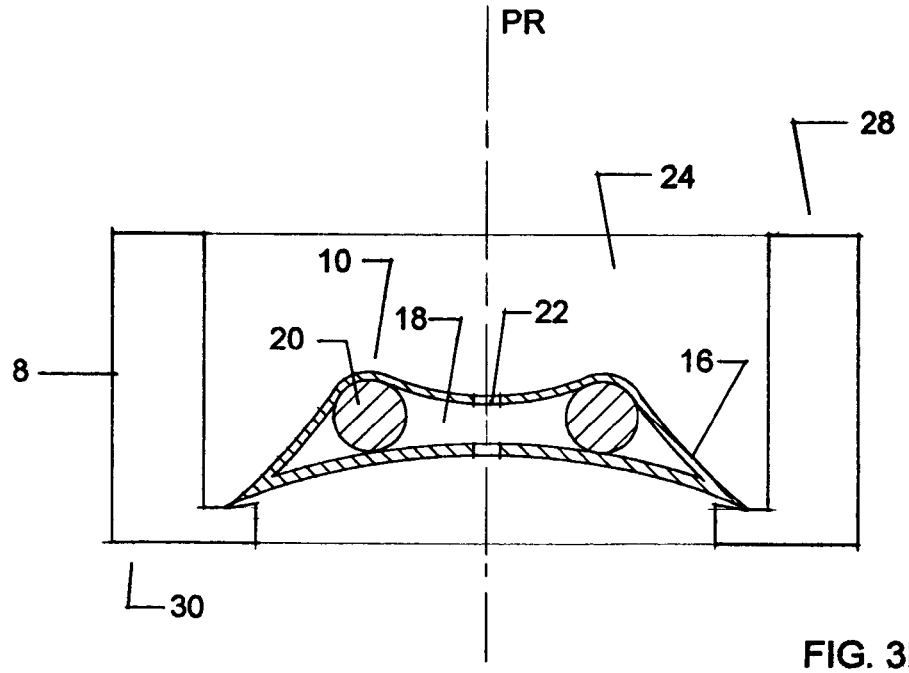

FIGS. 3A and 3B show cross sectional views along line 1—1 in FIG. 1 of a second embodiment of the present invention in a simplified representation of a head frame profile 8. The spring element 10 is located nearer to the midpoint within an opening 24. A hole 22 penetrates the resilient casing 16 on the axis of the stringing plane PR. FIG. 3B shows the second embodiment of the spring element 10 disposed within an opening 24 in the head frame profile 8 that is nearer to its inner facing surface 30.

Figure 4:
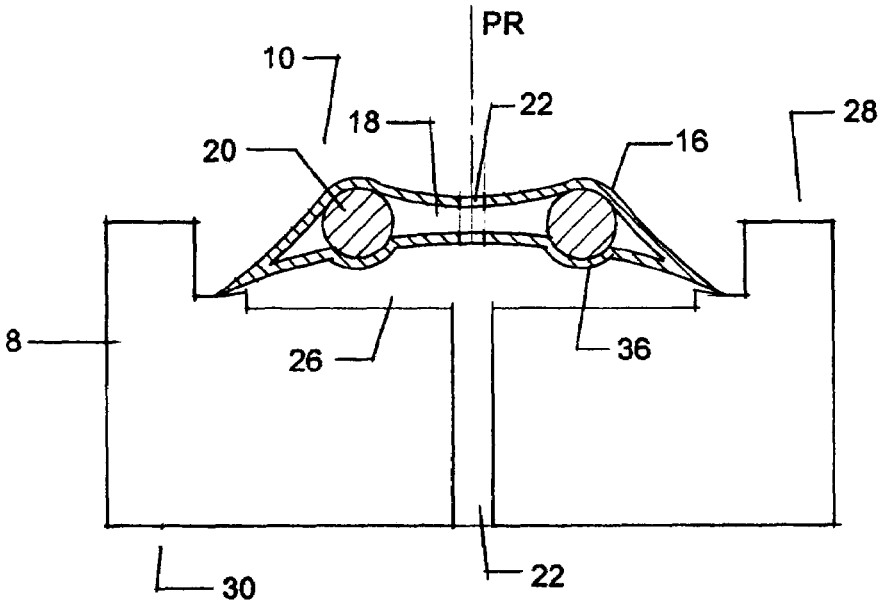
FIG. 4 shows a cross-sectional view along line 1—1 in FIG. 1 of another embodiment of the compound spring element disposed on a simplified representation of an alternate head frame profile.

FIG. 4 shows a cross-sectional view of a third embodiment of the compound spring element 10 according to the present invention. In this view of a simplified representation of a head frame profile 8, the casing 16 is disposed in a groove or indentation 26 on the outer facing surface 28 of the profile 8. In this particular embodiment, the profile of the casing 16 demonstrates the use of at least one recess 36 for the damping and/or elastomeric elements 20. This embodiment also requires that the inner facing surface 30 of the casing 16 has appropriate clearance from the head frame profile 8 to allow unrestricted deflection. A hole 22 in the element 10 has a corresponding hole 22 in the head frame profile 8 through which to receive a string 12 in tension; along the axis of the string plane PR.

Figure 5:
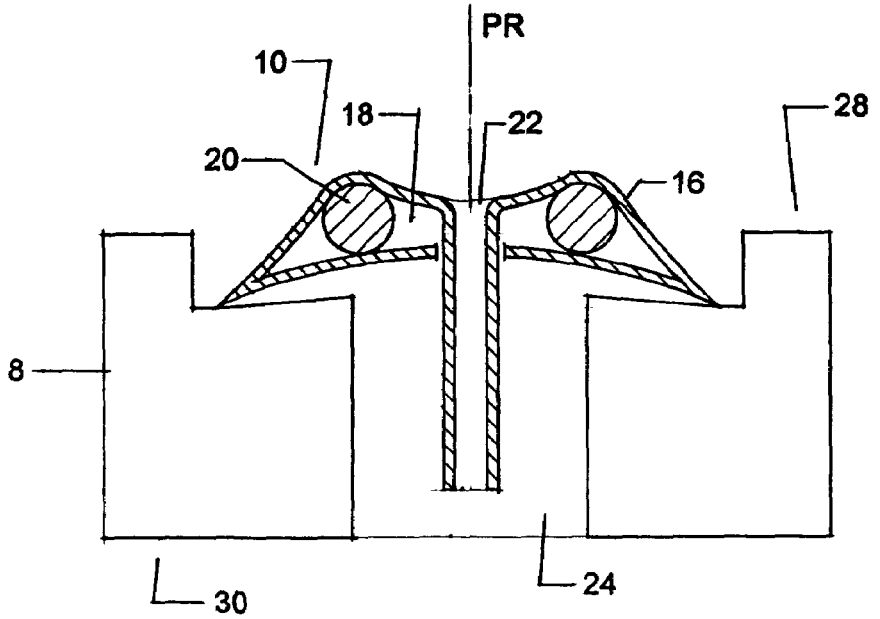
FIG. 5 shows a cross-sectional view along line 1—1 in FIG. 1 of an alternate embodiment of the spring element disposed on a simplified representation of an alternate head frame profile.

FIG. 5 is a cross-sectional view depicting a fourth alternate embodiment of the compound spring element 10 of the present invention. An outer facing surface 28 of the casing 16 penetrates through to its opposite side, forming a support member for the hole 22 and continues into the opening 24 of the simplified head frame profile 8. For ease of stringing, this particular embodiment of the spring element 10 allows the knot on the string to occur nearer the inner facing surface 30 of the profile 8. The damping and/or elastomeric element(s) 20 are shown contained within the space 18 on either side of the stringing plane PR, but could also be disposed between at least two holes 22 along a central axis defined by PR.

FIGS. 6A, 6B, 6C, and 6D are cross-sectional views illustrating other possible embodiments of the compound spring element 10 according to the present invention. The casing 16 of the particular embodiments described here are all made of a suitable, resilient material such as fiber-reinforced plastic or metal or a combination thereof. The spring element 10 of FIG. 6A has an interior space 18. The space 18 is further divided by at least one resilient wall section to form a fluid tight space 18 on either side of the stringing plane PR. The central space 18 is penetrated by the hole 22 along the axis of the stringing plane PR to receive a string in tension. This particular embodiment could also be formed without the central space 18.

Figure 6A:
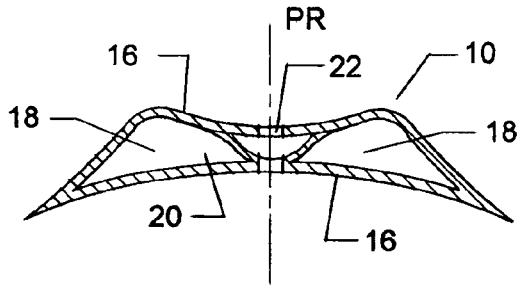
FIGS. 6A, 6B, 6C, and 6D show cross-sectional views of alternate embodiments of the compound spring element.
Figure 6B:
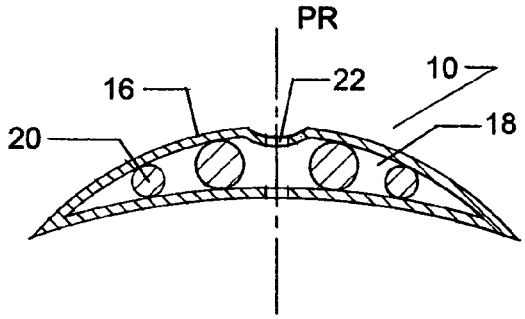
Figure 6C:
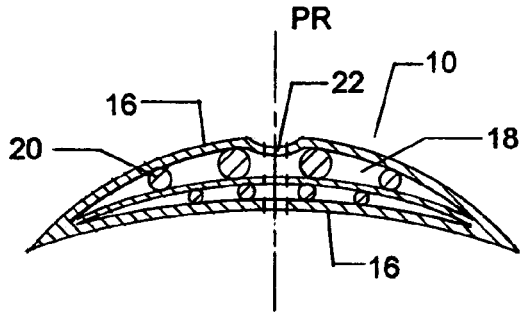
Figure 6D:
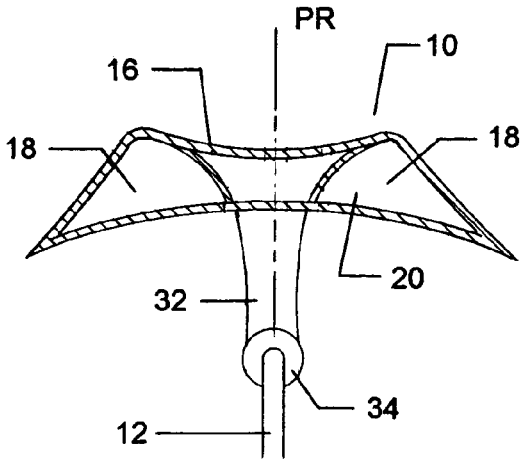

FIG. 6B shows the space 18 defined by the resilient casing 16, and containing a number of damping and/or elastomeric elements 20. A hole 22 is provided to lace the string 12 through the outer facing surface 28 of the casing 16. FIG. 6C shows a damped spring element 10 with the resilient casing 16 having more than one space 18. The space(s) 18 are formed by at least one internal wall section of resilient material, spanning from one closed end of the spring element 10 to a second closed end, and containing multiple damping and/or elastomeric elements 20. A hole 22 in line with the axis of the string plane PR is provided for the lacing of the string 12. The casing 16 of the spring element 10 in FIG. 6D defines a space 18. The space 18 is further divided by a resilient wall section to form a fluid tight space 18 on either side of the stringing plane PR. The centrally located space 18 receives a connecting aperture 32 with an eyelet 34 through which the string 12 is laced. The space(s) 18 in this fluid tight arrangement are capable of holding at least one damping and/or elastomeric element 20 such as a liquid, gas or vapor under pressure without the use of a hose or bladder.

The improved flexural capacity of the compound spring element 10 of the present invention results from the unified structural response of its parts to a string 12 in tension. The physical properties of the parts and how they interact determine the performance qualities of the element 10. It must be rigid enough to hold the string in tension, yet flexible enough to deflect in response to minimal increases in tension brought on by ball impact.

The profile of the casing 16 can be formed into a variety of shapes, each with different flex points and having distinctive reactions to deformation. Though the at least two side portions of the casing 16 are shown having complimentary curvatures, there are a number of other variations that would make structural sense. At least one side portion could be flat while at least another is curved. The curvatures could be concave or convex or reversed to face away from the stringing 14. The side portions of the casing 16 also can have bends which serve as flex points and/or recesses 36 to receive at least one damping and/or elastomeric elements 20.

The composition of the resilient material of the casing 16 is also critical to the behavior of the spring element 10. A suitable material such as fiber-reinforced plastic or aluminum, should be lightweight, resilient, and have the capacity for fabrication in varying thicknesses.

The characteristics of the damping and/or elastomeric elements 20 and the nature of their interaction with the casing 16 are also critical in determining the response properties of the compound spring element 10 of the present invention. In a preferred embodiment, the at least one element 20 within the at least one space 18 has both damping and elastic properties. The internal element(s) 20 can be for example, of an elastic material such as silicone, and are, e.g., corresponding lengths of a profile, for example a profile made of this material with a circular cross section.

The elements(s) 20 can also be hoses or tubes, for example, that are filled with a liquid or gas or air and are tightly sealed within the at least one internal space 18 of the compound spring element 10. The hoses can be pressurized to a chosen pressure during the assembly or remain non-pressurized until tensioning of the strings 12 occurs. Other alternative embodiments have been illustrated herein which show that a fluid tight space 18 can be formed by avoiding its penetration by a through hole 22 and/or a string 12. The composite flexural response of the spring element 10 in this case is due in part on the pressure within the space 18.

A wide range of flexural responses can be achieved by varying both the casing 16 material and shape, and the internal damping and/or elastomeric elements 20. In one preferred embodiment, the response is greatly enhanced when the at least one space 18 is filled with a fluid medium, particularly if the medium is enclosed in continuous loop around the periphery of the stringing 14. In this case, the state of equilibrium allows substantial numbers of adjacent strings to respond accordingly with increased tension to a concentration of forces on a small area of the strings due to ball impact.

The compound spring element 10 according to the present invention can engage the head frame 16 periphery of a game racket 2 in any number of appropriate locations. In one embodiment, the element 10 is a singular structurally independent unit cooperating with at least one string or it can be a multiple of elements 10 connected to form small segments and disposed on the head frame 16 to cooperate with portions of the stringing 14. In another preferred embodiment the element 10 is formed as a long continuous rail-like element to fit around the entire periphery of the head frame 6. The spring element 10 is adaptable to any size or shape of game racket and it can be made separately and installed during or after fabrication of the racket.

The head frame profile(s) 8 illustrated herein are simplified representations intended for reference only. There is great flexibility in requirements for the design of profile 8. The spring element 10 requires that the profile 8 provide a bearing surface facing away from the stringing 14. The head frame profile 8 should be generally wider than the element 10 and provide through holes and/or openings for the string(s) 12 to pass through. Lastly, the profile 8 should provide clearance for lateral flexion, in a direction perpendicular to and away from, the stringing plane PR, of the edges of the spring element 10. Because the compound spring element 10 includes at least one space 18 within a structurally independent unit, it's adaptable to a wide variety of head frame profiles. The element 10 can be disposed to span an opening in the frame as in FIGS. 2A and 2B, FIGS. 3A and 3B, and FIG. 5 or it can rest in an indentation 26 on the head frame profile 8 as in FIG. 4. Other variations are possible and will become apparent to those skilled in the art.

Although the foregoing invention has been described in terms of certain preferred embodiments, other preferred embodiments will become apparent to those of ordinary skill in the art in view of the disclosure herein. Accordingly, the present invention is not intended to be limited by the recitation of embodiments, but is intended to be defined by reference to the appended claims.

What is claimed is:

1. A spring element for a game racket, comprising:

a resilient casing having a first side portion and a second side portion, opposite and facing the first side portion, wherein the side portions define at least one space in between them; and at least one damping and/or tension element within the space between the side portions, wherein said resilient casing is to be disposed on at least one part of a head frame of the game racket to cooperate with at least one string in tension; and wherein the first side portion, when disposed on the head frame, interacts with said space and said second side portion to resist deformation when subjected to string, tension.

2. The spring element according to claim 1, wherein the element is adapted to deform, upon deflection of the at least one string, to ameliorate the increase in string tension and to generate a resistance force.

3. The element according to claim 1, wherein the at least one damping and/or tension element comprises a substance selected from the group consisting of a liquid, gas, and a vapor.

4. The element according to claim 1, wherein the at least one damping and/or tension element comprises a bladder filled with a substance selected from the group consisting of a liquid, gas, and a vapor.

5. The element according to claim 1, wherein the at least one damping and/or tension element comprises an elastomeric material.

6. The element according to claim 1, wherein the at least one damping and/or tension element comprises a solid, compressible material.

7. The element according to claim 5, wherein the at least one damping and/or tension element has a predetermined profile in an uncompressed state.

8. The element according to claim 1, wherein the element comprises eyelets and/or corresponding holes to receive the at least one string.

9. The element according to claim 1, further comprising a plurality of damping and/or tension elements located within the space.

10. The element according to claim 1, wherein the first side portion and a second side portion are generally concave.

11. The element according to claim 1, wherein the first side portion and a second side portion are generally convex.

12. The element according to claim 1, wherein the at least one space is further divided by at least one interior wall section.

13. The element according to claim 1, wherein the at least one space is fluid tight.

14. The element according to claim 1, further comprising a connecting armature including an eyelet for receiving the at least one string in tension.

15. The element according to claim 1, wherein the first side portion of the casing penetrates through the second side portion to form a supporting hole profile.

16. The element according to claim 1, wherein the element is formed with a mating circumferential curvature shape to extend along a total periphery of, and to mate with, the head frame.

17. The element according to claim 1, wherein the element is formed with a mating circumferential curvature shape to extend along a portion of the total periphery of, and to mate with, the head frame.

18. The element according to claim 1, wherein the resilient casing comprises at least one recess in at least one side portion to receive at least one damping and/or tension element.

19. The element according to claim 1, wherein the resilient casing comprises a fiber-reinforced plastic, a metal, or a carbon-metallic fiber plastic.

20. A game racket, comprising:

a handle, a head frame with strings held in tension, and a spring element, the spring element comprising:

a resilient casing having a first side portion and a second side portion, opposite and facing the first side portion, wherein the side portions define at least one space in between them; and at least one damping and/or tension element within the space between the side portions, wherein said resilient casing is disposed on at least one part of the head frame to cooperate with at least one string in tension, and wherein the first side portion, interacts with said space and said second side portion to resist deformation when subjected to string tension.

21. The game racket according to claim 20, wherein the spring element is adapted to deform, upon deflection of the at least one string, to ameliorate the increase in string tension and to generate a resistance force.

22. The game racket according to claim 20, wherein the at least one damping and/or tension element of the spring element comprises a substance selected from the group consisting of a liquid, gas, and a vapor.

23. The game racket according to claim 20, wherein the at least one damping and/or tension element of the spring element comprises a bladder filled with a substance selected from the group consisting of a liquid, gas, and a vapor.

24. The game racket according to claim 20, wherein the at least one damping and/or tension element of the spring element comprises an elastomeric material.

25. The game racket according to claim 20, wherein the at least one damping and/or tension element of the spring element comprises a solid, compressible material.

26. The game racket according to claim 24, wherein the at least one damping and/or tension element of the spring element has a predetermined profile in an uncompressed state.

27. The game racket according to claim 20, wherein the spring element comprises eyelets and/or corresponding holes to receive the at least one string.

28. The game racket according to claim 20, further comprising a plurality of damping and/or tension elements located within the space in the spring element.

29. The game racket according to claim 20, wherein the first side portion and a second side portion are generally concave.

30. The game racket according to claim 20, wherein the at least one space within the spring element is further divided by at least one interior wall section.

31. The game racket according to claim 20, wherein the at least one space within the spring element is fluid tight.

32. The game racket according to claim 20, wherein the spring element further comprises a connecting armature including an eyelet for receiving the at least one string in tension.

33. The game racket according to claim 20, wherein the first side portion of the spring element penetrates through the second side portion to form a supporting hole profile.

34. The game racket according to claim 20, wherein the spring element is formed with a mating circumferential curvature shape to extend along a total periphery of, and to mate with, the head frame.

35. The game racket according to claim 20, wherein the element is formed with a mating circumferential curvature shape to extend along a portion of the total periphery of, and to mate with, the head frame.

36. The game racket according to claim 20, wherein the spring element forms an internal space in relation to an outer facing surface of the head frame profile.

37. The game racket according to claim 35, further comprising at least one damping and/or tension element within the internal space.

* * * * *